United States Patent [19]

Atoji et al.

[11] 4,087,629

[45] May 2, 1978

[54] BINAURAL SOUND REPRODUCING SYSTEM WITH ACOUSTIC REVERBERATION UNIT

[75] Inventors: Nobuhisa Atoji, Toyanaka; Takahisa Aoi, Suita, both of Japan

[73] Assignee: Matsushita Electric Industrial Co., Ltd., Osaka, Japan

[21] Appl. No.: 758,142

[22] Filed: Jan. 10, 1977

[30] Foreign Application Priority Data

| | | |
|---|---|---|
| Jan. 14, 1976 | Japan | 51-3499 |
| Jan. 23, 1976 | Japan | 51-6852 |
| Oct. 7, 1976 | Japan | 51-121037 |

[51] Int. Cl.[2] ..... H04R 5/00

[52] U.S. Cl. ..... 179/1 G; 179/1 GP; 179/1 J

[58] Field of Search ..... 179/1 G, 1 GQ, 1 J, 179/156 R, 1 GP

[56] References Cited

U.S. PATENT DOCUMENTS

| | | | |
|---|---|---|---|
| 2,978,543 | 4/1961 | Kennedy | 179/1 J |
| 3,200,199 | 8/1965 | Bang | 179/1 G |
| 3,790,711 | 2/1974 | Ojima et al. | 179/1 GP |
| 3,894,196 | 7/1975 | Briskey | 179/1 G |
| 3,922,489 | 11/1975 | Ojima et al. | 179/1 J |

*Primary Examiner*—Douglas W. Olms

*Attorney, Agent, or Firm*—Stevens, Davis, Miller & Mosher

[57] ABSTRACT

A binaural sound reproducing system for transmitting sound radiated from an electro-acoustic transducer through a sound wave transmission path such as a pipe to the left and right ears of a listener includes an acoustic reverberation unit comprising a mechanical-acoustic element. The sound radiated from the electro-acoustic transducer is applied to the acoustic reverberation unit to produce indirect sound with acoustic reverberation. The indirect and direct sounds radiated from the electro-acoustic transducer are mixed and transmited through a sound wave transmission path such as the pipe to the left and right ears of the listener so that the sound image felt by the listener is localized externally of the head of the listener.

15 Claims, 16 Drawing Figures

BINAURAL SOUND REPRODUCING SYSTEM WITH ACOUSTIC REVERBERATION UNIT

The present invention relates to a binaural sound reproducing system for reproducing an acoustic-electric signal, and more particularly to a binaural sound reproducing system which converts an acoustic-electric signal to a sound wave by an electro-acoustic transducer and transmits the converted sound wave through a sound wave transmission path such as a pipe to the left and right ears of a listener.

A feature of the present invention resides in that an acoustic reverberation unit comprising a pure mechanical-acoustic element is used to produce indirect sound, the indirect sound being transmitted together with direct sound to the left and right ears of the listener so that the sound image felt by the listener is localized externally of the head of the listener.

Generally, when an electro-acoustic signal from a radio receiver set or the like is reproduced by a loudspeaker, sound radiated from the loudspeaker is transmitted directly to the left and right ears of the listener as direct sound and at the same time it is transmitted to the ears of the listener as indirect sound produced by the reflection from the walls and floors of a listening room.

Where such composite sound, composed of the direct indirect sounds, reaches the ears of the listener, he feels a sound image externally of his head because of the contribution by the indirect sound to acoustical distant perception to a sound image.

On the other hand, when the electroacoustic signal from the radio receiver or the like is reproduced by an earphone, there is a drawback in that the sound image is localized internally of the head of the listener. This is because no indirect sound is included when the sound is listened to by means of an earphone unlike the case where it is listened to through a loudspeaker.

In the light of the drawback described above, it is an object of the present invention to provide a binaural sound reproducing system in which the indirect sound is produced by passing the sound reproduced by an electro-acoustic transducer through an acoustic reverberation unit comprising a mechanical-acoustic element, and the indirect sound thus produced is mixed with the direct sound to transmit the composite sound to the ears of the listener so that the sound image is localized externally of the head of the listener.

Those and other objects, features and advantages of the present invention will be apparent from the following description of the preferred embodiments when taken in conjunction with the accompanying drawings, in which.

Figures 1, 2:
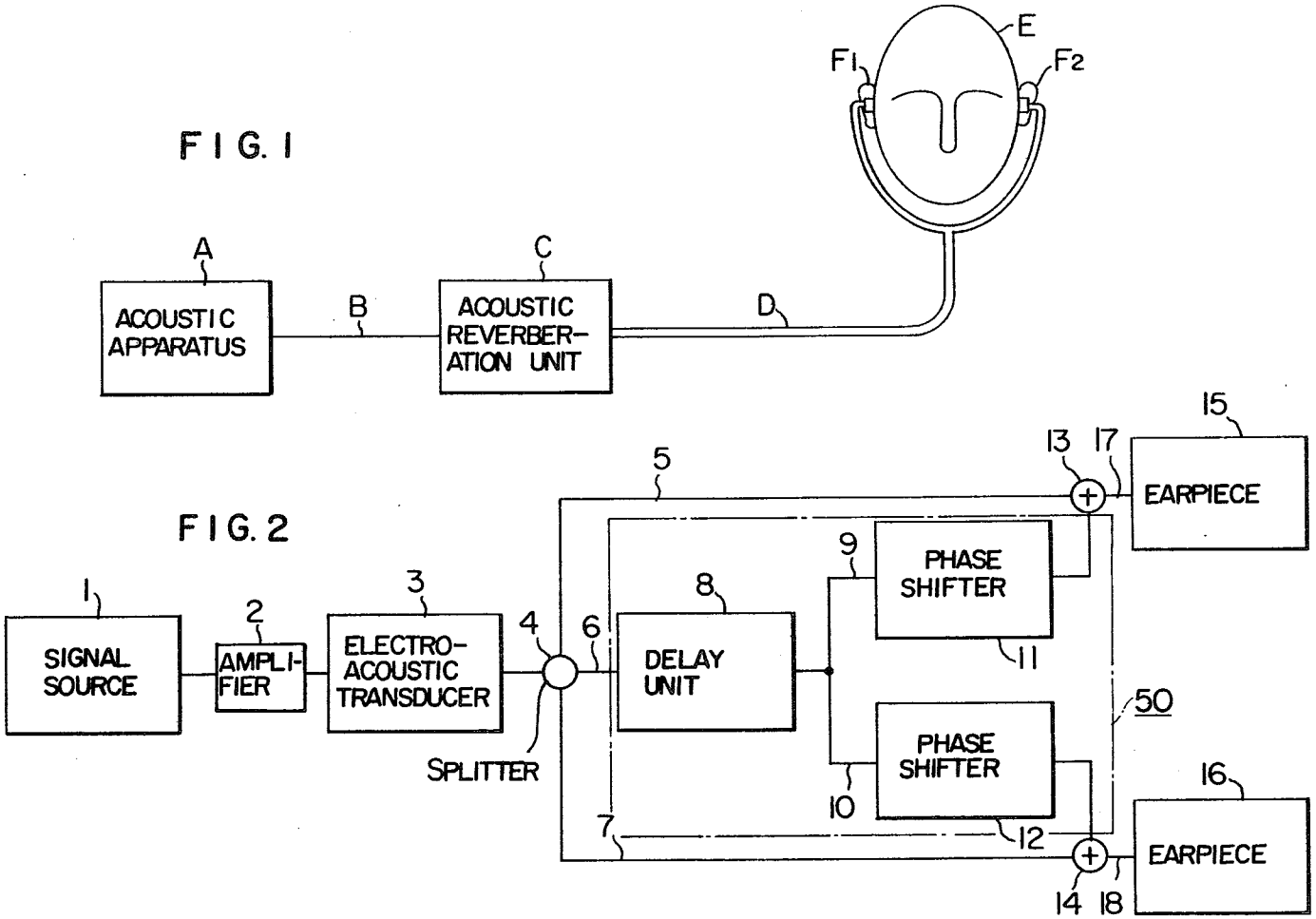
FIG. 1 is a schematic diagram of the present invention.
FIG. 2 is a block diagram of a basic construction of the present invention.

Now referring to the drawings, FIG. 1 shows a schematic diagram of the present invention. In FIG. 1, A denotes an acoustic apparatus such as a radio receiver set, television receiver set, magnetic recording and reproducing apparatus, electronic organ or the like. An electro-acoustic signal from the acoustic apparatus A is applied to an acoustic reverberation unit C through a line B. The acoustic reverberation unit C comprises an electro-acoustic transducer. Sound radiated from the electro-acoustic transducer is transmitted through a pipe D to ears $F_1$ and $F_2$ of a listener E. At the same time, a portion of the sound radiated from the electro-acoustic transducer is added with acoustic reverberation, which is transmitted as indirect sound through the pipe D to the ears $F_1$ and $F_2$. Accordingly, the listener E listens to the mixed sound of the direct sound and the indirect sound. The acoustic reverberation unit C may be housed in the acoustic apparatus A.

The present invention is now explained with particular reference to the acoustic reverberation unit in conjunction with the drawing.

FIG. 2 is a block diagram showing a basic construction of the present system. In FIG. 2, numeral 1 denotes a signal source such as tape recorder, tuner, player or the like, 2 denotes an amplifier, 3 an electro-acoustic transducer such as loudspeaker or earphone, 4 a splitter for splitting sound generated by the electro-acoustic transducer 3 into three acoustic transmission paths 5, 6 and 7, and 8 denotes a delay unit inserted in the acoustic transmission path 6. The sound generated by the electro-acoustic transducer 3 is transmitted as a direct sound through the acoustic transmission paths 5 and 7 and at the same time transmitted through the acoustic transmission path 6 to delay unit 8 to produce the indirect sound with acoustic reverberation effect being added. The indirect sound is split and passed to phase shifters 11 and 12 through acoustic transmission paths 9 and 10. The sounds whose phases were shifted by the phase shifters 11 and 12 are coupled to the acoustic transmission paths 5 and 7. In this manner, the direct sound transmitted through the acoustic transmission path 5 and the indirect sound transmitted through the acoustic transmission path 9 are combined in a mixer 13 and the resultant composite sound is transmitted through an acoustic transmission path 17 and a earpiece 15 to one ear of the listener. Similarly, the direct sound transmitted through the acoustic transmission path 7 and the indirect sound transmitted through the acoustic transmission path 10 are combined in the mixer 14 and the resultant composite sound is transmitted through an acoustic transmission path 18 and an earpiece 16 to the other ear of the listener. In this manner, since the direct sound as well as the indirect sound are transmitted to both ears, the listener feels the sound image externally of his head. A better acoustical distant perception (feeling of distance) to the sound image is obtained when a phase difference $|\phi_1 - \phi_2|$ is equal to 180°, when $\phi_1$ and $\phi_2$ are phase shifts by the phase shifters 11 and 12, respectively. Numeral 50 denotes an acoustic reverberation unit which includes the delay unit 8 and phase shifter 11 and 12.

Figure 3:
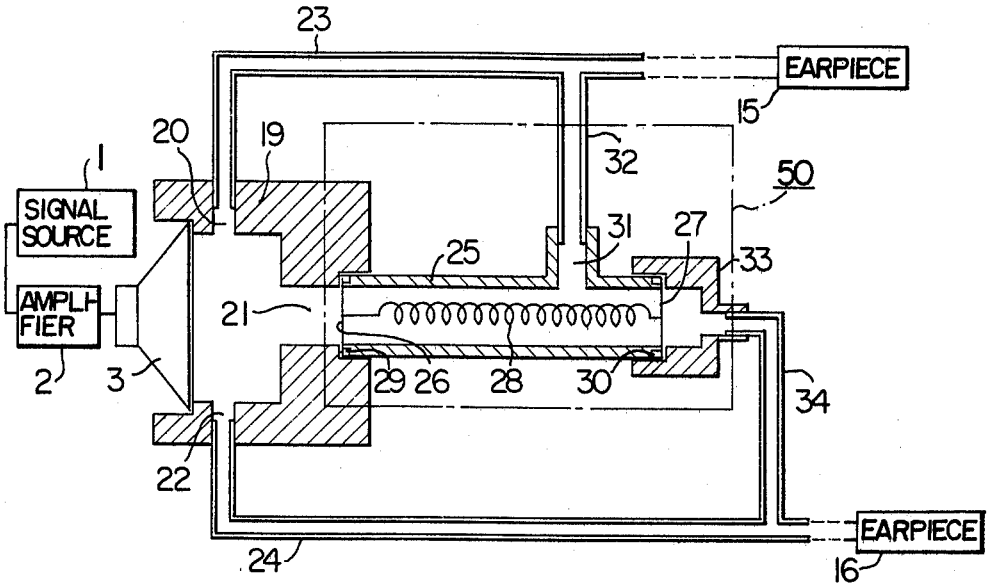
FIG. 3 shows one embodiment of the present invention.

FIG. 3 shows one embodiment of the present invention in which the same parts as those of FIG. 1 are designated by the same reference numerals. In FIG. 3, numeral 19 denotes a splitter mounted in front of the electro-acoustic transducer 3 such as an earphone or loudspeaker of the radio receiver set. The splitter 19 is made of resin or the like. The splitter 19 is formed with three bores 20, 21 and 22 and pipes 23 and 24 which serve as the acoustic transmission paths 5 and 7 in FIG. 2 are fitted in the bores 20 and 22. Numeral 25 denotes a cylindrical body having one end fitted into the bore 21 of the splitter 19. Attached to the opposite ends of the cylindrical body 25 are diaphragms 26 and 27 made of films to which ends of a spring 28 are fixed. Numerals 29 and 30 denote rings for fixing the diaphragms. The cylindrical body 25, the diaphragms 26 and 27 and the helical spring 28 constitute a delay unit 50. The diaphragm 26 is vibrated by the sound radiated from the electro-acoustic transducer 3 and reached to the bore 21, and the vibration of the diaphragm 26 is conveyed to the helical spring 28 as a mechanical vibration which in turn vibrates the other diaphragms 27. The transmission velocity $V_s$ at which the mechanical vibration propagates along the helical spring 28 is given by $V_s = (d/D) \times (gG/2\rho)^{1/2}$, where $d$ is the diameter of the wire of the spring, $D$ is the diameter of the spring, $G$ is the shearing elastic modulus, $\rho$ is the specific gravity of the helical spring material and $g$ is the gravity acceleration. The time delay T relative to the direct sound is given by $T = \pi nD/Vs$ where $n$ is the number of turns of the helical spring. As stated above, the diaphragm 27 is vibrated by the mechanical vibration transmitted through the helical spring 28, an acoustic reverberation effect is produced by the propagation of the vibration through the helical spring 28, and the indirect sound with the reverberation effect is produced by the viberation of the diaphragm 27. Numeral 31 denotes an outlet bore formed in a side of the cylindrical body 25 into which a pipe 32 branched from the pipe 23 is fitted. Numeral 33 denotes a coupling element fitted to the end of the cylindrical body 25 and a pipe 34 branched from the pipe 24 is fitted into the coupling element 33.

As shown in FIG. 2, the cylindrical body 25, the diaphragm 26 and 27 and helical spring 28, and the coupling element 33 constitute a reverberation unit 50.

The indirect sound with the acoustic reverberation effect being added is mixed with the direct sound transmitted through the pipes 23 and 24 and the mixed sound is transmitted to the ears of the listener through the earpieces 15 and 16.

Figure 4:
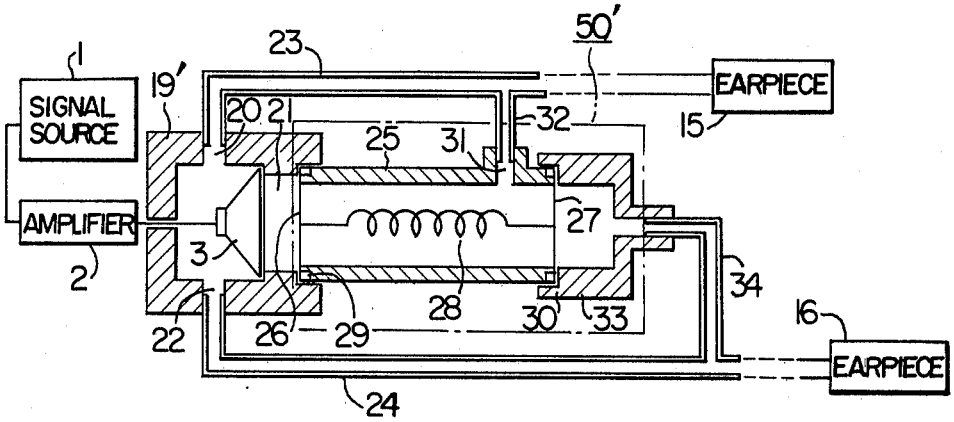
FIG. 4 shows another embodiment of the present invention.

FIG. 4 shows another embodiment of the present invention in which the same parts as those shown in FIG. 3 bear the same reference numerals.

In the present embodiment, the loudspeaker 3 is housed in a splitter 19' so that sound radiated from the front of the loudspeaker 3 is guided to the acoustic reverberation unit while sound radiated from the rear of the loudspeaker 3 is guided to the pipes 23 and 24 through the bores 20 and 22 of the splitter 19'. Again, in the present embodiment, the phase difference between the indirect sound derived from the pipe 32 and the indirect sound derived from the pipe 34 is set to be equal to 180°. consequently the cylindrical body 25, the diaphragm 27 and coupling element 33 constitute the phase shifter 11 and 12 shown in FIG. 2.

While there exists a possibility of the indirect sound generated by the vibration of the diaphragm 26 being mixed with the direct sound through the splitter 19 in the embodiment of FIG. 3, the embodiment of FIG. 4 has the advantage that the direct sound and the indirect sound are completely separated from each other.

Figure 5:
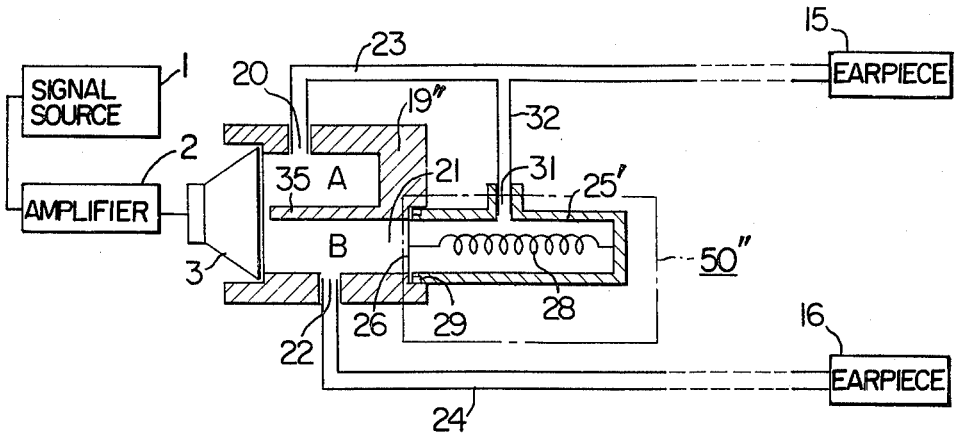
FIG. 5 shows a third embodiment of the present invention.

FIG. 5 shows a third embodiment of the present invention in which the same parts as those shown in FIG. 3 bear the same reference numerals.

In FIG. 5, numeral 19'' denotes a splitter having a partition 35 by which the space in the splitter 19'' is divided into sections A and B. Numeral 25' denotes a cylindrical body having one end thereof closed, and a diaphragm 26 is attached to the other open end by a ring 29. Numeral 28 denotes a helical spring having one end fixed to the diaphragm 26 and the other end fixed to the closed end of the cylindrical body 25'.

In the present embodiment, the sound wave radiated from the loudspeaker 3 is divided into two parts by the partition 35, and the part of the sound wave radiated to the section A is guided to the pipe 23 as the direct sound while the part of the sound wave radiated to the section B is guided to the pipe 24 as the direct sound. On the other hand, one of the indirect sounds whose phases differ by 180° from each other and which are generated on opposite sides of the diaphragm 26 is transmitted through the pipe 32 and mixed with the direct sound. The other indirect sound is guided to the pipe 24 through the section B and also mixed with the direct sound.

According to the embodiment shown in FIG. 5, only a single diaphragm is necessary for the acoustic reverberation unit and the coupling element 33 and the pipe 34 shown in the embodiments of FIGS. 3 and 4 are eliminated. Accordingly, the structure is simplified and the manufacturing cost is reduced.

In the embodiment of FIG. 5, since the acoustic reverberation unit is coupled to the section B, the mechanical impedances of the sections A and B as seen from the diaphragm of the loudspeaker 3 may differ from each other. In this case, it is necessary to adjust the position of the partition 35 to change the volume ratio of the sections A and B or to insert an acoustic resistance element in the space to make the mechanical impedances equal to each other.

The helical spring 28 in each of the above embodiments may be a tension coil spring of piano wire, in which case it is preferable to establish a wire-to-wire separation such that the spring wire does not contact an adjacent one.

The binaural sound reproducing system of the present invention thus constructed has the following advantages:

1. Since the sound image is localized externally of the listener's head, the fatigue which has been experienced in listening by means of a prior art earphone or headphone due to the localizing of the sound image internally of the listener's head can be eliminated.

2. The structure is simple because no pure electric or electronic components are used; instead a mechanical-acoustic element is included.

3. Manufacturing cost is reduced.

While the above embodiments are directed to the sound reproducing system for reproducing a monaural acoustic-electric signal, the present invention is equally applicable to a sound reproducing system for a stereophonic acoustic-electric signal.

Figure 6:
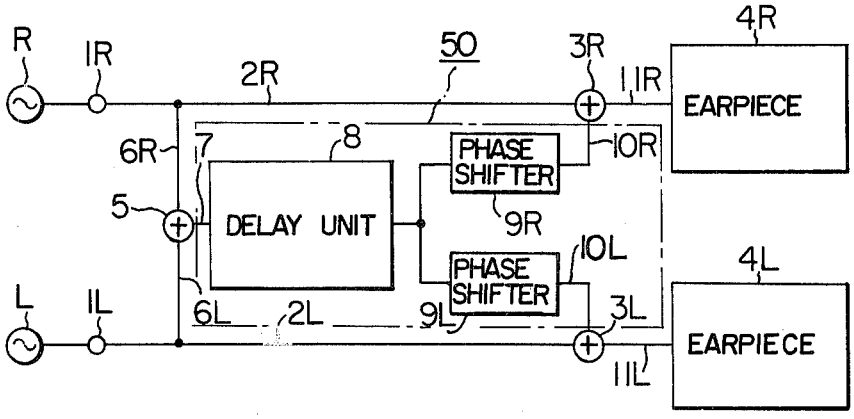
FIG. 6 is a block diagram illustrating the basic construction of a binaural sound reproducing system for a stereophonic apparatus.

FIG. 6 is a block diagram showing a basic construction of the sound reproducing system for a stereophonic signal. In FIG. 6, R and L denote signal sources for generating right and left stereo-signals, respectively, 1R and 1L denote electro-acoustic transducers such as a loudspeaker or earphones for converting the electric signals generated by the signal sources R and L to sound waves, 2R and 2L denote acoustic transmission paths for transmitting the sounds generated by the electro-acoustic transducers 1R and 1L through mixers 3R and 3L and earpieces 4R and 4L to the ears of the listener, numeral 5 denotes a mixer for mixing the sounds generated by the electro-acoustic transducers 1R and 1L through acoustic transmission paths 6R and 6L, numeral 7 denotes an acoustic transmission path for transmitting the composite sound, numeral 8 denotes a delay unit comprising a mechanical-acoustic element for adding an acoustic reverberation effect to the composite sound, and 9R and 9L denote phase shifters for phase shifting the composite sound to which the acoustic reverberation effect has been added by the delay unit 8. The two indirect sounds whose phases were thus shifted are coupled to the acoustic transmission paths 2R and 2L through acoustic transmission paths 10R and 10L and the mixers 3R and 3L. In this manner, the direct sound transmitted through the acoustic transmission path 2R and the indirect sound transmitted through the acoustic transmission path 10R are combined in the mixer 3R and the resultant composite sound is transmitted through an acoustic transmission path 11R and an earpiece 4R to one ear of the listener. Similarly, the direct sound transmitted through the acoustic transmission path 2L and the indirect sound transmitted through the acoustic transmission path 10L are combined in the mixer 3L and the resultant composite sound is transmitted through an acoustic transmission path 11L and a earpiece 4L to the other ear of the listener. In this manner, since both the direct sound and the indirect sound are transmitted to respective ears of the listener, he can feel the sound image externally of his head. A better acoustical distant perception to the sound image is obtained when the phase difference $|\phi_1 - \phi_2|$ is equal to 180°, where $\phi_1$ and $\phi_2$ are the phase shifts introduced by the phase shifters 9R and 9L, respectively. Numeral 5O denotes an acoustic reverberation unit which includes the delay unit 8 and phase shifter 9R and 9L.

Figure 7:
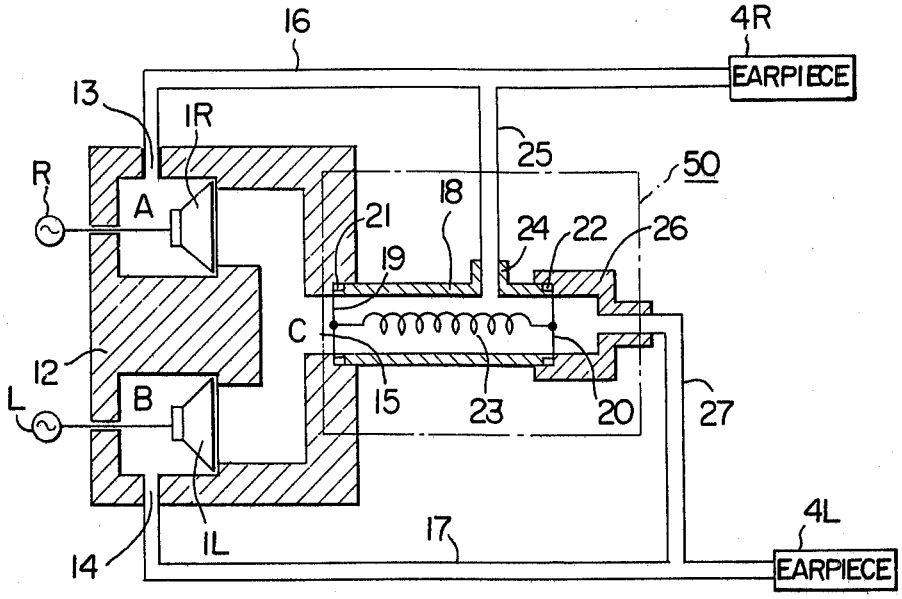
FIG. 7 shows a fourth embodiment of the present invention.

FIG. 7 shows an embodiment of the present invention in which the same parts as those shown in FIG. 6 bear the same reference numerals.

In FIG. 7, R and L denote signal sources, 1R and 1L denote electro-acoustic transducers such as a loudspeaker, earphone or head-phones, which are supported in a housing 12 which is made of resin or the like. Within the housing 12, spaces A and B and a space C of a U-shaped cross section are formed and bores 13, 14 and 15 which communicate with the spaces A, B and C are also formed. Numerals 16 and 17 denote pipes fitted into the bores 13 and 14, respectively. The pipes 16 and 17 serve as the acoustic transmission paths 2R and 2L, respectively, shown in FIG. 6. The sounds radiated in the rear of the electro-acoustic transducers 1R and 1L are transmitted to the ears through the pipes 16 and 17. Numeral 18 denotes a cylindrical body having one end thereof fitted to the bore 15 of the housing 12. At opposite ends of the cylindrical body 18, diaphragms 19 and 20 made of films are attached by fixing rings 21 and 22. Numeral 23 denotes a helical spring having its opposite ends fixed to the diaphragms 19 and 20. The cylindrical body 18, the diaphragms 19 and 20 and the helical spring 23 constitute the delay unit. The sounds radiated by the electro-acoustic transducers 1R and 1L which reach the bore 15 through the space C cause the diaphragm 19 to vibrate and this vibration is conveyed to the spring 23 as a mechanical vibration, by which the other diaphragm 20 is vibrated. The transmission velocity $V_s$ at which the mechanical vibration is propagated along the helical spring 23 is given by $V_s = (d/D) \times (gG/2\rho)^{1/2}$, where $d$ is the diameter of the wire of the helical spring, $D$ is the diameter of the spring, $G$ is the shearing elastic modulus of spring material, $\rho$ is a specific gravity of the spring material and $g$ is the gravity acceleration. The time delay T relative to the direct sound is given by $T = \pi nD/V_s$, where $n$ is the number of turns of the helical spring. As described above, the diaphragm 20 is vibrated by the mechanical vibration propagated through the helical spring 23 and an acoustic reverberation effect is added by the propagation of the vibration through the helical spring 23 so that the indirect sound with the acoustic reverberation effect being added by the vibration of the diaphragm 20 is produced. Numeral 24 denotes an outlet bore formed in a side of the cylindrical body 18, to which bore a pipe 25 branched from the pipe 16 is fitted. Numeral 26 denotes a coupling element fitted into the end of the cylindrical body 18. A pipe 27 branched from the pipe 17 is fitted into the coupling element 26. Numeral 5O denotes an acoustic reverberation unit which consists of cylindrical body 18, the diaphragm 19 and 20, helical spring 23 and the coupling element 26.

In this manner, the indirect sound with the acoustic reverberation effect being added thereto is mixed with the direct sounds transmitted through the pipes 16 and 17, and the mixed sounds are transmitted through the earpieces 4R and 4L to the listener's ears. Since the indirect sounds transmitted through the pipes 25 and 27 are those radiated to the rear side and the front side of the diaphragm 20, respectively, the phase difference between the radiated indirect sound waves is equal to 180°. Consequently the cylindrical body 18, the diaphragm 20 and the element 26 constitute the phase shifters 9R and 9L shown in FIG. 6.

When the listener listens to sounds with the earpieces 4R and 4L of the stereophonic sound reproducing system shown in FIG. 7 being mounted to the right and left ears respectively, the listener feels the sound image externally of his head because the composite sounds of the direct sound and the indirect sound reach both ears.

Figure 8:
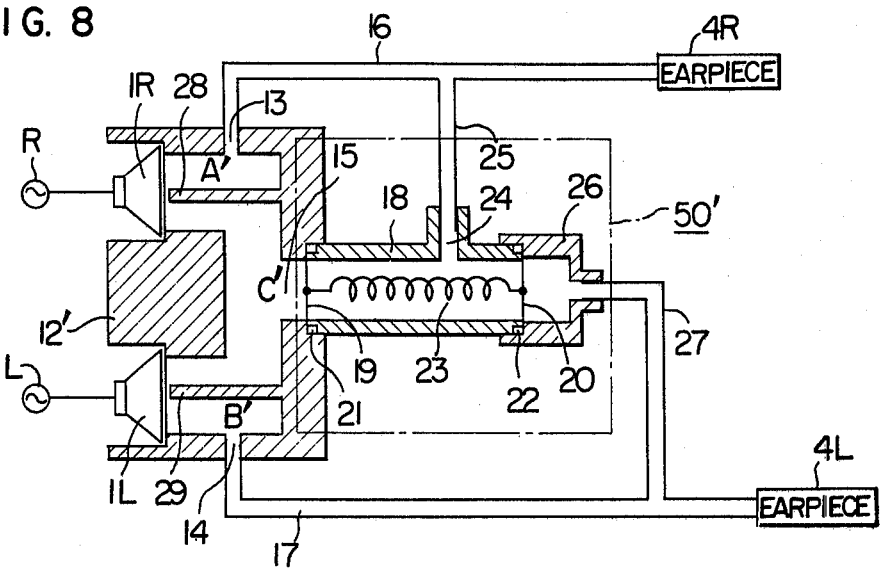
FIG. 8 shows a fifth embodiment of the present invention.

FIG. 8 shows another embodiment of the present invention. In FIG. 8, numeral 12′ denotes a housing in which partitions 28 and 29 are provided to divide the space in the housing 12′ into three spaces A′, B′ and C′. Numeral 13, 14 and 15 denote bores communicating with the spaces A′, B′ and C′, respectively. In the present embodiment, the sounds radiated in the fronts of the electro-acoustic transducers 1R and 1L are split by the partitions 28 and 29, respectively, and the sound radiated to the space A′ is transmitted as the direct sound through the pipe 16, the sound radiated to the space B' is transmitted as the direct sound through the pipe 17, and the sounds radiated to the space C' are combined and transmitted through the delay unit and through the pipes 25 and 27 as the indirect sounds of different phases.

In the embodiment of FIG. 8, since the acoustic reverberation unit 5O' is coupled to the space C', the mechanical impedance for the space A' (or B') as seen from the diaphragms of the electro-acoustic transducers 1R and 1L may differ from that for the space C'. In this case, the positions of the partitions 28 and 29 may be adjusted to change the volume ratio of the space A' (or B') and the space C', or an acoustic impedance element may be inserted in the space to make the mechanical impedance equal to each other.

The helical spring 23 in the above embodiments may be a tension or coiled spring made of piano wire, in which case it is preferable to establish a wire-to-wire separation such that the spring wire does not contact an adjacent one.

The embodiments of FIGS. 7 and 8 may also be used as a monaural system, in which case the same electric signal is applied to both the electro-acoustic transducers.

Figure 9:
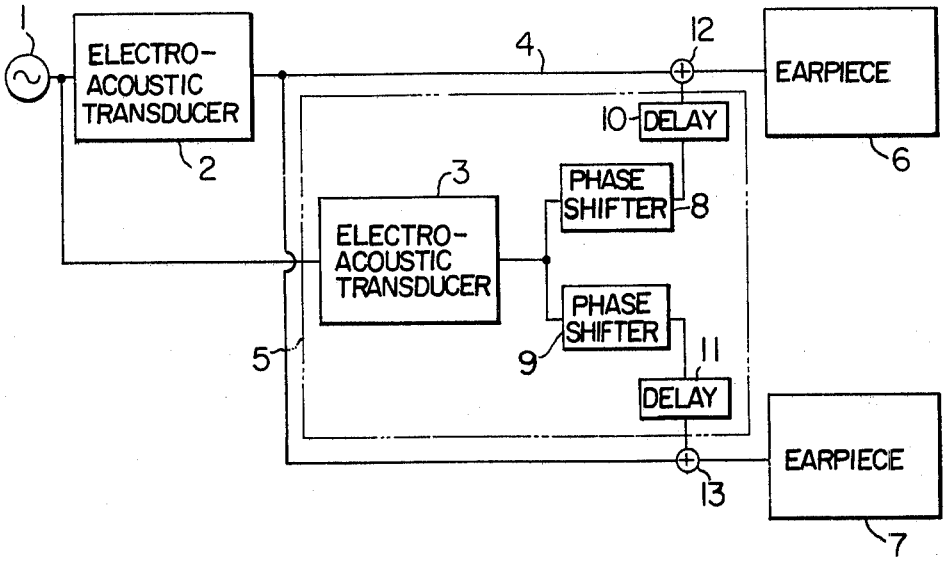
FIG. 9 is a block diagram illustrating the basic construction of a monaural apparatus.
Figure 10:
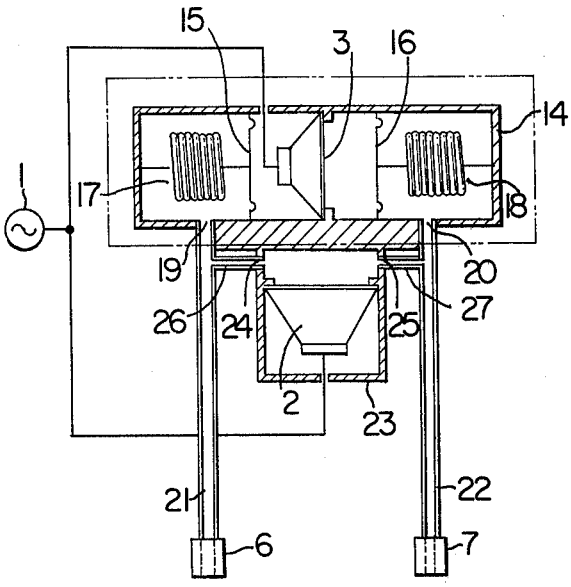
FIG. 10 shows an embodiment for the apparatus of FIG. 9.

Referring now FIGS. 9 and 10, another embodiment of the monaural system is explained. The present embodiment is characterized by the use of two electro-acoustic transducers each for the direct sound and the indirect sound.

FIG. 9 is a block diagram illustrating a basic embodiment of the present invention. In FIG. 9, numeral 1 denotes a signal source such as radio receiver set, tape recorder, tuner, player or the like, and numerals 2 and 3 denote electro-acoustic transducers for converting the electric signal from the signal source 1 to a sound wave. The sound radiated from the electro-acoustic transducer 2 is transmitted through acoustic transmission paths 4 and 5 such as pipes to the left and right ears of a listener as the direct sound. Numerals 6 and 7 denote earpieces formed at the ends of the acoustic transmission paths 4 and 5, respectively. The ends of the acoustic transmission paths 4 and 5 such as pipes are mounted to the ears of the listener by the earpieces 6 and 7. Numerals 8 and 9 denote phase shifters for phase shifting the sound generated by the electro-acoustic transducer 3. The sounds which have been phase shifted through the phase shifters 8 and 9 are then delayed in delay units 10 and 11, respectively, to produce indirect sounds, which are combined with the direct sound at mixers 12 and 13. The resultant mixed sounds of the direct sound and the indirect sound are transmitted to the left and right ears of the listener.

In the embodiment of FIG. 9, since the direct sounds and the indirect sounds are transmitted to the ears of the listener, the sound image is localized externally of the listener's head, unlike the case in which he listens by an earphone or the like. A better acoustical distant perception to the sound image is obtained when the phase difference $|\phi_1 - \phi_2|$ is equal to 180°, where $\phi_1$ and $\phi_2$ are the phase shifts introduced by the phase shifters 8 and 9, respectively.

Details of the above embodiment are now explained.

In FIG. 10, numeral 14 denotes a cylindrical body having its opposite ends closed. A loudspeaker 3 is mounted at the center within the cylindrical body 14 such that the loudspeaker 3 sections the space in the cylindrical body 14. Numerals 15 and 16 denote diaphragms mounted to partition the inside of the cylindrical body 14 in front of and to the rear of the loudspeaker 3 mounted in the cylindrical body 14, and numerals 17 and 18 denote helical springs each having one end thereof fixed to the diaphragms 15 and 16 respectively and the other ends fixed to the end surfaces of the cylindrical body 14. Numeral 19 and 20 denote bores formed in the side of the cylindrical body 14. The bores 19 and 20 are located between the diaphragms 15 and 16, respectively, and the respective end surfaces of the cylindrical body 14. Numerals 21 and 22 denote pipes having one ends thereof fitted into the bores 19 and 20, respectively, and the other ends thereof coupled to earpieces 6 and 7, respectively. Numeral 23 denotes a housing having one end thereof closed with an open end thereof being attached to the side of the cylindrical body 14.

The loudspeaker 2 is housed in the housing 23. Numerals 24 and 25 denote bores formed in the housing 23. One end of the pipes 26 and 27 are fitted into the bores 24 and 25, respectively. The other ends of the pipes 26 and 27 are coupled to the pipes 21 and 22, respectively.

When a signal is applied from the signal source 1 to the loudspeaker 2 and 3, sound waves are radiated from the loudspeaker 2 and 3. The sound radiated from the loudspeaker 2 is transmitted through the bore 24, pipe 26 and pipe 21 to one ear of a listener as the direct sound and at the same time transmitted through the bore 25, pipe 27 and pipe 22 to the other ear of the listener as the direct sound.

On the other hand, the diaphragm 16 is vibrated by the sound radiated to the front of the loudspeaker 3. Since the helical spring 18 is fixed to the diaphragm 16, the diaphragm 16 vibrates after a predetermined time delay and the sound wave is radiated from the diaphragm 16. This sound wave is transmitted through the bore 20 and the pipe 22 to one ear of the listener as the indirect sound.

Similarly, the sound radiated to the rear of the loudspeaker 3 causes the diaphragm 15 to vibrate after a predetermined time delay, and the sound wave radiated by the diaphragm 15 is transmitted through the bore 19 and pipe 21 to the other ear of the listener as the indirect sound. The sound waves produced by the vibration of the diaphragms 15 and 16 have phase difference of 180° from each other because they are generated by the sounds radiated to the front and rear of the loudspeaker 3. Consequently the loudspeaker acts as the phase shifters 8 and 9 shown in FIG. 9.

In the present embodiment, since the diaphragms are mounted in the front and rear of the indirect sound generating loudspeaker 3, the indirect sounds having the phase difference of 180° from each other are generated and hence a better acoustical distant perception to the sound image is obtained.

Another embodiment in which the two indirect sounds generated by the acoustic reverberation unit are completely out of phase so that the sound image is localized more clearly externally of the listener's head is now explained. In the previous embodiments shown in FIGS. 3, 5, 7 and 8, it is anticipated that a considerable volume of the direct sound wave is mixed into the acoustic reverberation unit. For example, referring to FIG. 4, the loudspeaker 3 radiates the sound wave into the front space 21 on the side of the acoustic reverberation unit 50' as well as into the rear impedances of the loudspeaker. Namely the vibration of the diaphragm 26 is caused by the radiated direct sound wave component, and when the power of the sound pressure which is generated by the viberation of the diaphragm 26 becomes large or strong, the power of the sound pressure (indirect sound) of the time lag T which is generated by the vibration of the diaphragm 27 may be exceeded by the power of the direct sound wave component just mentioned.

Figure 11:
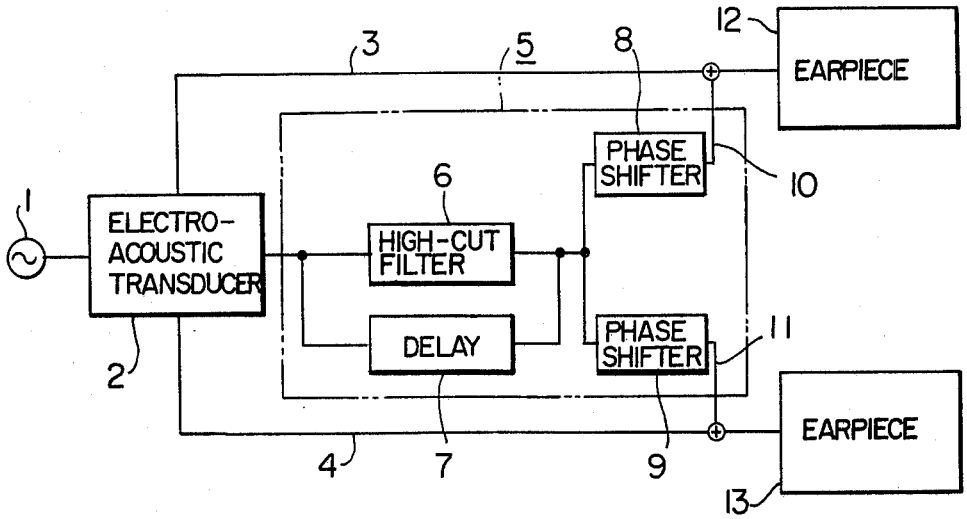
FIG. 11 is a block diagram illustrating the principle of another improvement in accordance with the present invention.
Figure 12:
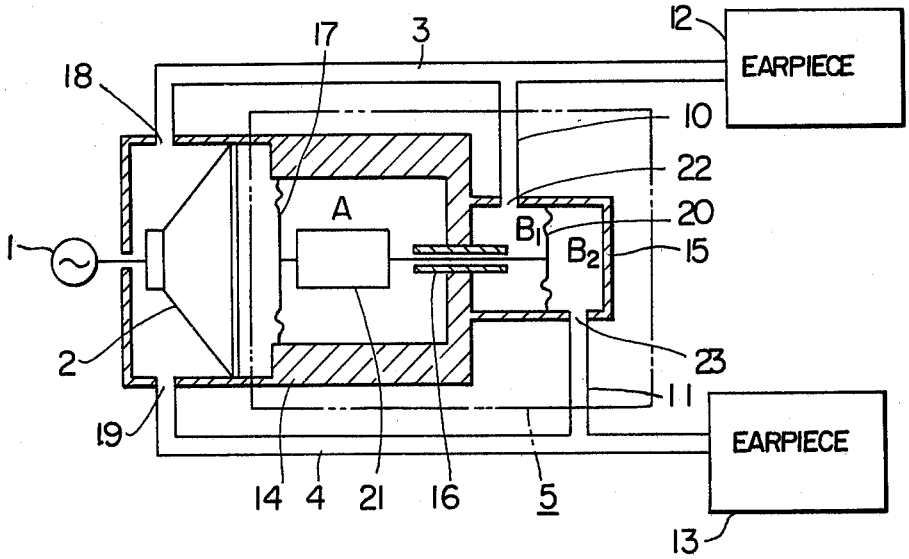
FIG. 12 shows an embodiment of the apparatus of FIG. 11.

Thus the two indirect sounds may be in phase and the sound image is no longer localized completely externally of the listener's head. Referring to FIGS. 11 and 12, an embodiment which completely eliminates such a problem is explained.

In FIG. 11, numeral 1 denotes a signal source, and numeral 2 denotes an electro-acoustic transducer such as a loudspeaker. Sound waves radiated from the electro-acoustic transducer 2 are transmitted through acoustic transmission paths 3 and 4 such as pipes as the direct sound and at the same time supplied to an acoustic reverberation unit 5, which comprises a high cut-off acoustic filter 6, a delay unit 7 and phase shifters 8 and 9. The high cut-off acoustic filter 6 constitutes a band pass filter for the direct sound supplied to the acoustic reverberation unit 5. The delay unit 7 comprises a spring or the like, and the sound radiated from the electro-acoustic transducer 2 is transmitted to the spring of the delay unit 7 where it is delayed relative to the direct sound. The delayed sound is divided into two parts which are passed through phase shifters 8 and 9 to produce two indirect sounds of different phase from each other. The indirect sounds are then transmitted through the respective acoustic transmission paths 10, 11 such as pipes and mixed with the direct sounds transmitted through the direct sound transmission paths 3 and 4. Numerals 12 and 13 denote earpieces attached to the ends of the acoustic transmission paths 3 and 4. Thus, mixed sounds of the direct sounds and the indirect sounds are transmitted through the earpieces 12 and 13 to the left and right ears of the listener.

Details of the present embodiment are explained with reference to FIG. 12.

In FIG. 12, numerals 14 and 15 denote cylindrical bodies. The cylindrical body 15 is fixed to one end surface of the cylindrical body 14, and a tube 16 of a small diameter extends through a partition wall between the cylindrical bodies 14 and 15. The cavities within the cylindrical bodies 14 and 15 communicate with each other through the tube 16. A loudspeaker 2 is fixed within the cylindrical body 14, and a diaphragm 17 is mounted in front of the loudspeaker 2 to partition the inside of the cylindrical body 14. Numerals 18 and 19 denote bores formed in the cylindrical body 14, and acoustic transmission paths 3 and 4 such as pipes are fitted in the bores 18 and 19 to transmit sound wave radiated in the rear of the loudspeaker 2 as the direct sound wave. Numeral 20 denotes a diaphragm mounted in the cylindrical body 15 to partition the inside of the cylindrical body 15. Numeral 21 denotes a helical spring having its one end fixed to the diaphragm 17 and other end thereof fixed to the diaphragm 20. Numerals 22 and 23 denote bores formed in the cylindrical body 15, one bore 22 of which communicates with a cavity $B_1$ partitioned by the diaphragm 20 in the cylindrical body 15 while the other bore 23 communicates with the other cavity $B_2$ in the cylindrical body 15. Acoustic transmission paths 10 and 11 are fitted in the bores 22 and 23, respectively.

The operation of the embodiment of FIG. 12 is now explained. When a signal is applied to the loudspeaker 2, sound waves are radiated to the front and rear of the loudspeaker 2. The sound wave radiated to the rear is transmitted through the bores 18 and 19 and the acoustic transmission paths 3 and 4. On the other hand, the sound wave radiated to the front of the speaker 2 causes the diaphragm 17 to vibrate, the vibration being transmitted to the helical spring 21 as a mechanical vibration, which in turn is transmitted to the diaphragm 20 to cause it to vibrate. In this case, the mechanical vibration velocity $V_s$ propagated along the helical spring 21 is given by $V_s = d \times (gG/2\rho)^{1/2}/D$, where $d$ is the diameter of the wire of the helical spring, $D$ is the diameter of the helical spring, $G$ is the transverse elastic modulus of the helical spring material, $g$ is the gravity acceleration and $\rho$ is the density of the helical spring material. Accordingly, the delay time T of the indirect sound due to the vibration of the diaphragm 20 relative to the direct sound is given by $T = \pi Dn/V_s$, where $n$ is the number of turns of the helical spring 21. In this manner, the diaphragm 20 vibrates with the delay time T relative to the direct sound and the sound waves are radiated to the front and rear of the diaphragm 20. The sound waves radiated to the front and rear of the diaphragm 20 have a phase difference of 180° from each other. The sound waves of different phases are transmitted through the bores 22 and 23 and the acoustic transmission paths 10 and 11 as the indirect sounds, which are then mixed with the direct sounds transmitted through the acoustic transmission paths 3 and 4 to the left and right ears of the listener.

In FIG. 12, when the diaphragm 20 in the cylindrical body 15 is vibrated by the sound wave generated in the cavity A by the vibration of the diaphragm 17, which is effected independently of the vibration of the helical spring 21, the two indirect sounds would be in phase causing the feeling of the localization of the sound image external of the listener's head to be less complete. Thus it is not preferable that the direct sound wave component mixes or goes into the space of the cylindrical body 15 due to vibration of the diaphragm 17. In the present embodiment, a tube 16 is provided to constitute the high-cut-off acoustic filter for preventing such sound wave radiated by the diaphragm 17 from mixing into the cylindrical body 15 through the cavity A. Thus the high frequency component of the direct sound wave is attenuated within the cylindrical body 15, and the pure indirect sound of the time lag T due to the helical spring 21 is obtained. The high-cut-off acoustic filter is now explained in detail. Where the volume of the cavity A is much larger than the volume of the cavity B, the high-cut-off acoustic filter is comprised of the inertance of the tube 16 and the acoustic compliance corresponding to the volume of the cavity B. When the acoustic compliance of the diaphragm 20 is very small compared with that corresponding to the volume of the cavity B, the acoustic compliance constituting the high-cut-off filter is a combination of the acoustic compliance corresponding to the volume of the cavity $B_1$ in the cylindrical body 15 facing the cylindrical body 14 of the compliance of the cavity $B_1$ and the compliance of the diaphragm 20.

As described above, according to the present embodiment, the indirect sound is not affected by the direct sound and hence the feeling of the localization of the sound image external of the listener's head is not damaged.

Figure 13:
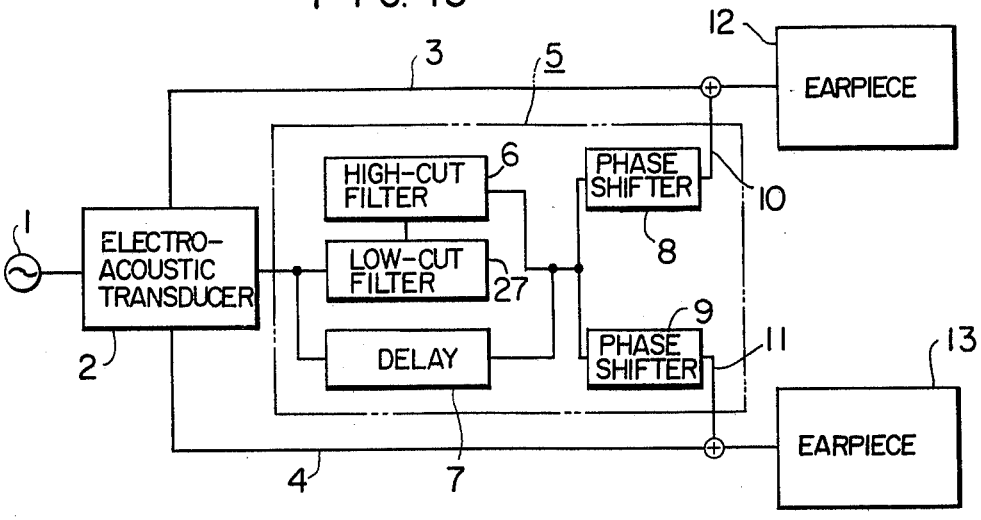
FIG. 13 is a block diagram illustrating another improvement.
Figure 14:
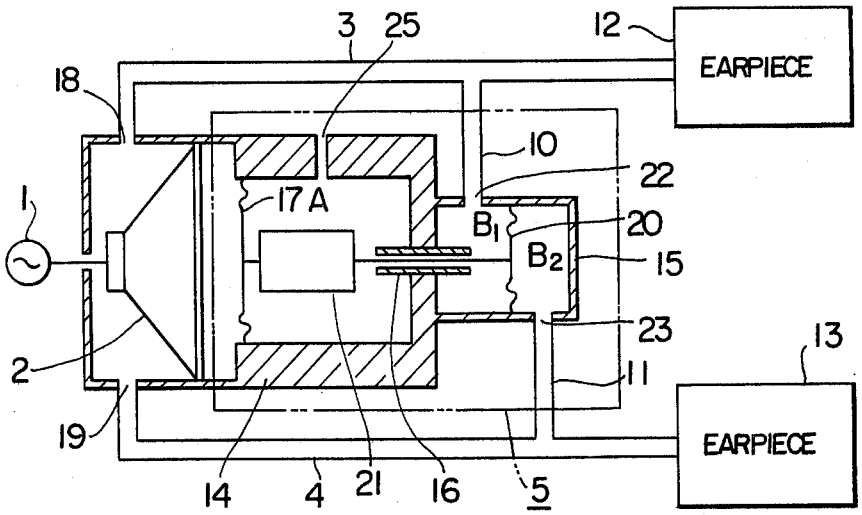
FIG. 14 shows an embodiment of the apparatus of FIG. 13.

Referring to FIGS. 13 and 14, an embodiment wherein the direct sound has less influence on the indirect sound than in the embodiment of FIG. 12 is explained. As shown in FIG. 13, the feature of the present embodiment resides in that a high-cut-off acoustic filter 6 as well as a low-cut-off acoustic filter 27 are arranged in an acoustic reverberation unit 5. As shown in FIG. 14, a tube 16 of a small diameter extends through the partition wall between the cylindrical bodies 14 and 15, as in the embodiment of FIG. 12, to form the high-cut-off acoustic filter while a small bore 25 is formed in the cylinder body 14 to form the low-cut-off acoustic filter. The small bore 25 formed in the cylindrical body 14 has an inertance component which acts as a leakage inductance to the cavity A in the cylindrical body 14. Thus, when the sound wave is radiated into the cavity A by the diaphragm 17, the small bore 25 acts as the leakage inductance so that the low frequency region of the sound wave radiated from the diaphragm 17 is attenuated or eliminated by the leakage inductance of the small bore 25 to block the transmission to the cavity B in the cylindrical body 15. A low-cut-off frequency may be adjusted by changing a cross sectional area or length of the small bore 25.

Figure 15:
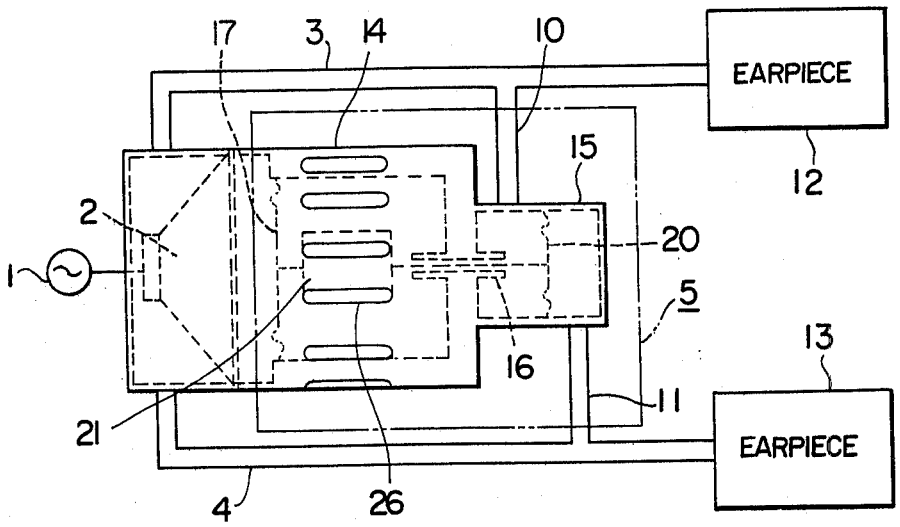
FIG. 15 shows an improved construction of the apparatus of FIG. 14.

FIG. 15 shows other embodiment which differs from the embodiment of FIG. 14 in that a plurality of slits 26 are formed in the cylindrical body 14 to form the low-cut-off acoustic filter.

Figure 16:
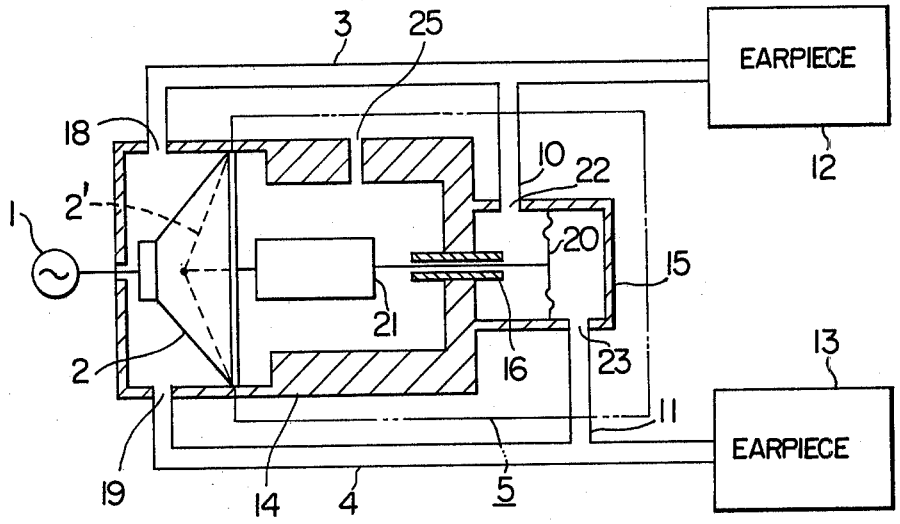
FIG. 16 shows a still further embodiment of the present invention.

FIG. 16 shows a still further embodiment of the present invention, which differs from the embodiment of FIG. 14 in that the diaphragm 21 of FIG. 14 is excluded and one end of the helical spring 21 which was fixed to the diaphragm 21 is directly fixed to the vibration cone 2' of the loudspeaker 2. Accordingly the present embodiment needs the loudspeaker 2 having a large mechanical impedance in comparison with that of the loudspeaker used in the embodiment of FIG. 14. According to the arrangement of FIG. 16, the diaphragm 21 can be eliminated with the result of a lower manufacturing cost for the system.

What is claimed is:

1. A binaural sound reproducing system comprising a pair of acoustic transmission paths for transmitting a sound wave radiated from a electro-acoustic transducer directly toward the left and right ears of a listener as direct sounds, an acoustic reverberation unit for adding an acoustic reverberation effect to the sound wave radiated from said electro-acoustic transducer to produce two indirect sounds of different phases, and means for guiding said two indirect sounds into said acoustic transmission paths and combining the guided indirect sounds with said direct sounds respectively to transmit the combined sounds to the left and right ears of the listener respectively.

2. A binaural sound reproducing system according to claim 1, wherein said two indirect sounds have a phase difference of 180° with respect to each other.

3. A binaural sound reproducing system according to claim 1, wherein said acoustic transmission paths comprise pipes.

4. A binaural sound reproducing system according to claim 1, wherein said acoustic reverberation unit comprises a cylindrical body, diaphragms attached at opposite ends of said cylindrical body and a spring having its opposite ends fixed to respective ones of said diaphragms.

5. A binaural sound reproducing system according to claim 1, wherein the sound wave radiated from one side of said electro-acoustic transducer is guided to said acoustic reverberation unit while the sound wave radiated from the other side of said electro-acoustic transducer is guided to said pair of acoustic transmission paths as the direct sounds.

6. A binaural sound reproducing system according to claim 1, wherein a space in front of said electro-acoustic transducer is divided into two spaces which are connected to said respective acoustic transmission paths, one of said spaces being further coupled to said acoustic reverberation unit, and the two indirect sounds of different phases generated in said acoustic reverberation unit are guided to said respective acoustic transmission paths.

7. A binaural sound reproducing unit according to claim 6, wherein said acoustic reverberation unit comprises a cylindrical body having one closed end and the other end open, a diaphragm attached to said open end of said cylindrical body, and a spring having one end thereof fixed to said diaphragm and the other end thereof fixed to said closed end of said cylindrical body.

8. A binaural sound reproducing system comprising a pair of electro-acoustic transducers for converting left and right stereo-signals to respective sound waves, a pair of acoustic transmission paths for transmitting said respective sound waves radiated from said respective electro-acoustic transducers directly to the ears of a listener as direct sounds, an acoustic reverberation unit for combining the sound waves radiated from said respective electro-acoustic transducers and adding an acoustic reverberation effect to a resultant composite sound for producing two indirect sounds of different phases, and means for guiding said two indirect sounds into said acoustic transmission paths and combining the guided indirect sounds with said direct sounds respectively to transmit the combined sounds to the left and right ears of the listener respectively.

9. A binaural sound reproducing system according to claim 8, wherein said two indirect sounds have a phase difference of 180° with respect to each other.

10. a binaural sound reproducing system according to claim 8, wherein said acoustic transmission paths comprise pipes.

11. A binaural sound reproducing system according to claim 8, wherein said acoustic reverberation unit comprises a cylindrical body, diaphragms attached at opposite ends of said cylindrical body and a spring having its opposite ends fixed to respective ones of said diaphragms.

12. A binaural sound reproducing system according to claim 8, wherein the sound waves radiated from one side of each of said electro-acoustic transducers are guided to said acoustic reverberation unit while the sound waves radiated from the other side of each of said electro-acoustic transducers are guided to said respective acoustic transmission paths as the direct sounds.

13. A binaural sound reproducing system according to claim 8, wherein each of the spaces in front of the respective electro-acoustic transducers are divided into two spaces, one of which is connected to said respective acoustic transmission paths and the other of which is coupled to said acoustic reverberation unit, and the two indirect sounds of different phases generated in said acoustic reverberation unit are guided to said respective acoustic transmission paths.

14. A binaural sound reproducing system according to claim 1, wherein said acoustic reverberation unit comprises a first cylindrical body and a second cylindrical body communicated with each other by a tube of a small diameter, a first diaphragm mounted in said first cylindrical body and a second diaphragm mounted in said second cylindrical body, and a spring having one end thereof fixed to said first diaphragm and the other end thereof fixed to said second diaphragm.

15. A binaural sound reproducing system according to claim 1, wherein said acoustic reverberation unit comprises a cylindrical body, a diaphragm attached at one end of said cylindrical body and a spring having one end fixed to said diaphragm and its other end fixed to a cone of said electro-acoustic transducer.

* * * * *